US006210249B1

(12) United States Patent
Stadlbauer

(10) Patent No.: US 6,210,249 B1
(45) Date of Patent: Apr. 3, 2001

(54) MECHANICAL MODEL OF AN ANIMAL

(76) Inventor: Andreas Stadlbauer, Stanzingstrasse 7/II, Elsbethen, A-5061 (AT)

( * ) Notice: Subject to any disclaimer, the term of this patent is extended or adjusted under 35 U.S.C. 154(b) by 0 days.

(21) Appl. No.: 09/355,554

(22) PCT Filed: Dec. 9, 1997

(86) PCT No.: PCT/EP97/06869

§ 371 Date: Jul. 30, 1999

§ 102(e) Date: Jul. 30, 1999

(87) PCT Pub. No.: WO98/34702

PCT Pub. Date: Aug. 13, 1998

(30) Foreign Application Priority Data

Feb. 6, 1997 (DE) ..... 197 04 515

(51) Int. Cl.[7] ..... A63H 3/20; A63H 11/00; A63H 13/00; A63H 3/46

(52) U.S. Cl. ..... 446/330; 446/352; 446/355; 446/356; 446/377; 446/383

(58) Field of Search ..... 446/352, 353, 446/355, 356, 377, 383, 296, 305, 330

(56) References Cited

U.S. PATENT DOCUMENTS 2,859,554 * 11/1958 Walss .
3,200,538 * 8/1965 Glass .
4,185,413 * 1/1980 Goldfarb .
4,245,515 * 1/1981 Iwaya .
4,629,440 12/1986 McKittrick .
4,820,232 * 4/1989 Takahashi .
4,878,874 * 11/1989 Terzian ..... 446/355
5,378,189 * 1/1995 Chiu ..... 446/353
5,906,531 * 5/1999 Llorens ..... 446/340

FOREIGN PATENT DOCUMENTS 90 13 042 U 1/1991 (DE) .
43 33 866A 4/1995 (DE) .

* cited by examiner

*Primary Examiner*—Jacob K. Ackun
*Assistant Examiner*—Bena B. Miller
(74) *Attorney, Agent, or Firm*—Lowe Hauptman Gilman & Berner, LLP

(57) ABSTRACT

The invention relates to a mechanical model of an animal, especially a toy dog with forelegs and hind legs which are pivotally arranged around a first pivot with a rotation axis perpendicular to the direction of movement of the animal model, wherein the forelegs are articulated by a first drive mechanism with a first gear unit and a first drive axis. Said arrangement is configured in such a way that at least one hind leg is pivotally arranged around a second pivot, wherein the rotation axes of the hind leg are tilted in relation to each other at a given angle and a second drive mechanism is provided for selectable movement of the hind leg around the second pivot.

32 Claims, 9 Drawing Sheets

POSITION 1

POSITION 2

POSITION 3

POSITION 4

POSITION 5

POSITION 6
38
40
42
44
46
48
49
50
26

POSITION 7

POSITION 8

POSITION 9

POSITION 10

POSITION 11

POSITION 12

MECHANICAL MODEL OF AN ANIMAL

The invention relates to mechanical animal-modeling as defined in the preamble of claim 1.

Mechanical animal models and in particular mechanical dogs are known of which the fore legs and hind legs are mobile in such manner that the mechanical dog can move forward.

An electromechanically driven motional and walking mechanism is known from the German Patent document A1 43 33 866 as the basis for the manufacture of walking human and animal models. In this quasi robotic design, a hip and shoulder joint with its three degrees of freedom has modeled using several servomotors in series. However this apparatus incurs the drawback of being mechanically complex and costly. Moreover the implementation of forward motion by simulating the hip joint almost naturally requires dynamic equilibrium with corresponding difficult and computer-intensive control of the servomotors of all legs to prevent the animal model from falling down.

An electromechanically driven motional and walking mechanism is known from the German patent document A1 43 33 866 as the basis for the manufacture of walking human and animal models. In this quasi robotic design, a hip and shoulder joint with its three degrees of freedom has been modeled using several servomotors in series. However this apparatus incurs the drawback of being mechanically complex and costly.

Because of the feature of the invention that the first and second drive mechanism are rigidly configured relative to each other in a torso of the animal model, there is the advantage that the actions carried out by real animals, for instance dogs, can be simulated or played back in corresponding manner by the mechanical animal model. In especially advantageous manner, two mutually offset axes of rotation at one hind leg can simulate the leg-raising and corresponding relieving of the animal. Such relieving is carried out by a dog for instance to scent its territory. Moreover the apparatus of the invention advantageously offers an especially simple mechanical design with corresponding simplified selective mechanism control for a forward motion of the animal model with static equilibrium or to simulate a relieving action by the animal model with corresponding "leg-raising" without tipping over the animal model. Corresponding simplified selective mechanism control for a forward motion of the animal model with static equilibrium or to simulate a relieving action by the animal model with corresponding "leg-raising" without tipping over the animal model.

The function "dog relieving i.e., urination" can be especially realistically imitated in that the angle between the two axes of rotation be 90°. As a result the particular hind leg will be substantially raised laterally.

A mechanically and operationally reliable movement of the hind leg with two pivots is achieved in that the second drive mechanism drives a disk with a first cam slot. This cam slot is engaged by a first cam pin of a compensating lever supported at a pivot point and fitted with a second cam slot engaged by a second cam pin of a lever linking the at least one hind leg to its second picot, so that, when the disk is being rotated, the lever moves the hind leg to-and-fro about the second pivot by an angle predetermined by the first cam slot.

A second drive shaft is provided in the gearing unit of the first drive mechanism to provide other functions of the mechanical animal model, an actuator being affixed to said shaft which by means of head lever actuates a rotatable lower jaw, a movable tongue and/or a bellows at a head part.

Appropriately this drive means is a rotary disk with at least one salient cooperating with an end of the head part.

To selectively actuate the first or second drive mechanism of the first gearing unit, the latter comprises at least one shaft, displaceable into at least a first and second position, fitted with at least one gear, or a shaft with at least one gear displaceable into a first or second position, the particular gear transmitting in the first position a drive force to the first drive shaft and in the second position a drive force to the second drive shaft. For this purpose the shaft or the gear will be appropriately be spring-biased and be axially displaceable against the spring force.

In order to pass from actuation through the first drive mechanism to actuation through the second drive mechanism at accurately predetermined positions of the fore and hind legs, preferably a first switch is employed which automatically activates the second drive mechanism when commanded by an operator and deactivates the first drive mechanism.

To assure that the mechanical model shall remain stably erect on three legs—so that this model shall not fall down when the fourth leg is lifted—the first switch is positioned in such manner that it can be automatically actuated in a position of the fore legs wherein the fore leg diagonally opposite the hind leg to be actuated is vertically closer to the ground than the other fore leg and the other hind leg.

A second switch is preferably provided for a correspondingly defined switching reversal from the second to the first drive mechanism in order to deactivate the second drive mechanism as commanded by an operator and to activate the first drive mechanism.

Appropriately an operating system fitted with selection means controlled by an operator is provided to transmit to the first and to the second switch a command to actuate the first or the second drive mechanism. Illustratively the operating system wires the selection means to the switches. Preferably the selection means is three position switch, a first position deactivating the mechanical animal model, a second position transmitting a command to actuate the first drive mechanism and a third position a command to actuate the second drive mechanism. Preferably the operating system includes a power source to power the first and the second drive mechanism. In especially preferred manner, the power source is at least one battery and the operating system shall connect the power source by electrical lines to the switches and the drive mechanisms.

For life-like movements of the fore legs, these are eccentrically linked at the first pivot of the first gearing unit to a first drive shaft and they are also supported in rotatable manner at a third pivot distant from the first and are displaceable in the direction of a longitudinal axis of the fore legs.

To achieve a corresponding synchronized motion between the hind legs and the fore legs when moving forward, preferably a first lever is mounted in each case at the first eccentric pivot of each fore leg, the other end of this first lever in each case being connected to a second lever mounted at the first pivot of a particular hind leg.

To easily mechanically control the optimal actuation time of the second drive mechanism, a drive means for a first switch is provided in such manner at one of the first levers that the drive means can control the switch when the fore leg which is diagonally opposite the hind leg with the second pivot is vertically closer to the ground relative to the first drive shaft than the other fore leg and the other hind leg.

To imitate in a most life-like manner the function of the dog or animal relieving itself, a liquid container and a liquid hose from the container to the rear of the animal model are employed, a pump selectively driven by the second drive mechanism moving the liquid from the container to the rear. The liquid is discharged from an end of the liquid hose. Appropriately a second gearing unit having a shaft axially displaceable into a first position and a second position and fitted with at least one gear or a shaft having at least one gear displaceable axially into a first and second position is provided in the second drive mechanism to selectively control the raising of the hind leg or the liquid pump, the particular gear in the first position transmitting a drive force on a plunger of the liquid pump. The shaft or the gear are appropriately spring biased and are axially displaceable against the spring force.

The invention is elucidated below in relation to the drawing.

Figure 1:
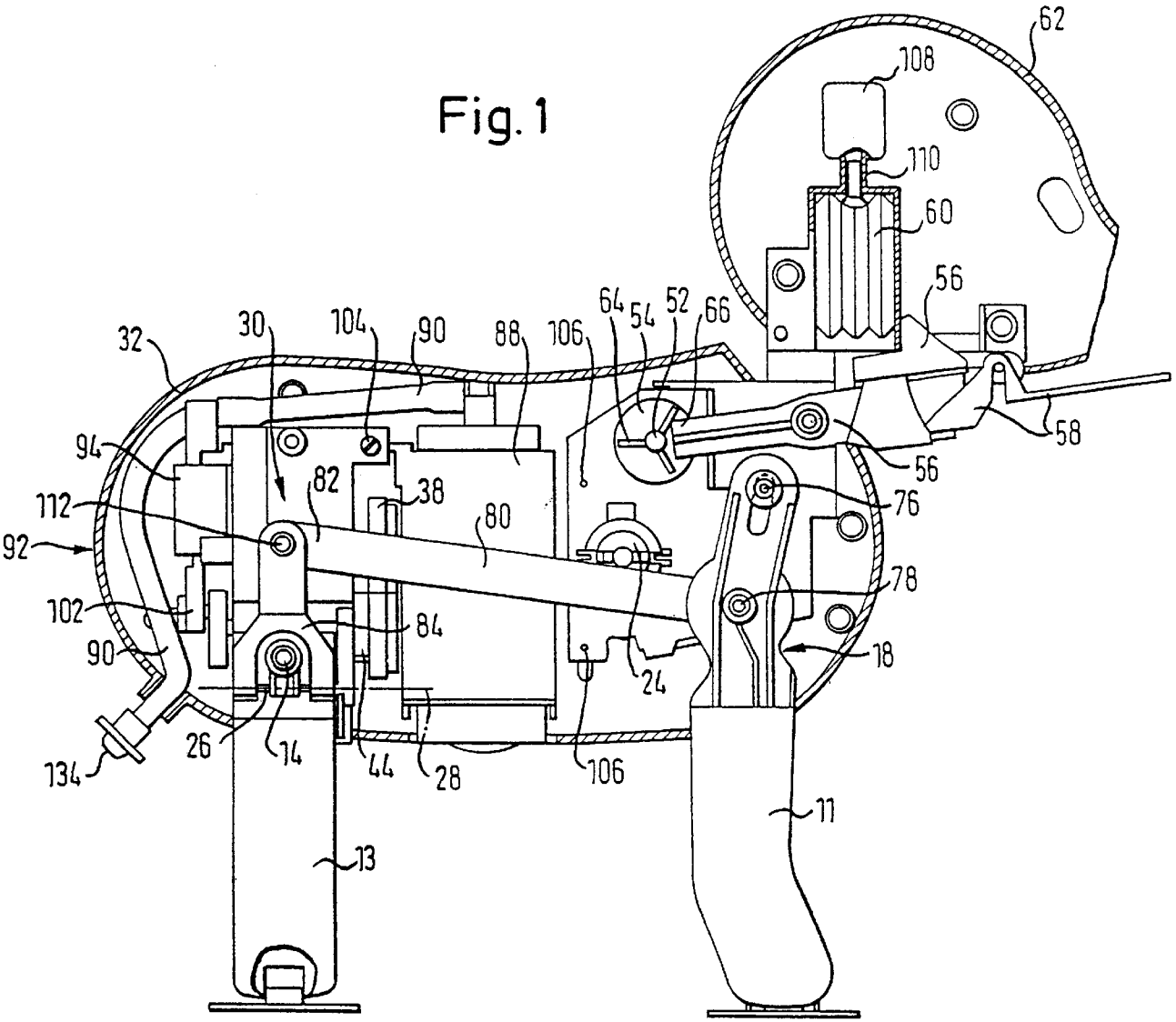
FIG. 1 is a longitudinal section of the mechanical dog of the invention.
Figure 2:
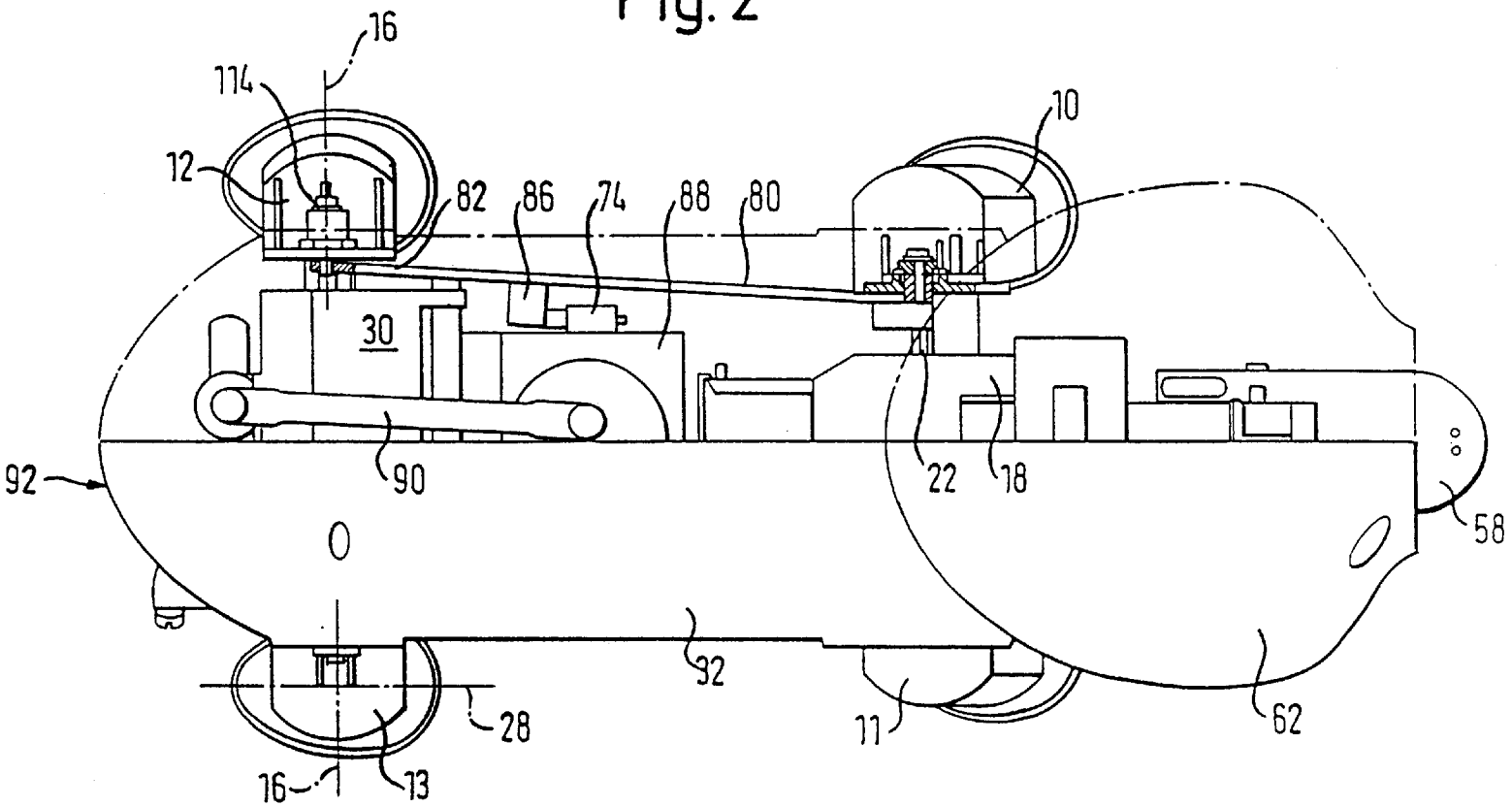
FIG. 2 is a partly sectional topview.

The mechanical dog shown in FIGS. 1 and 2 comprises, in and at a housing, namely a torso 32, a first drive mechanism 18, a second drive mechanism 30, fore legs 10 and 11, hind legs 12 and 13, a head segment 62 and a water system with a liquid container 88, a liquid hose 90, a liquid pump 94 with plunger 102 and a discharge aperture 134.

The drive means of a first drive mechanism 18 is an electric motor 24 which through a gearing unit elucidated below in relation to FIGS. 4 and 5 selectively drives the forelegs 11 or an actuator 54. The fore legs 11 in this process are driven by a first drive shaft 22 (FIG. 2) and an eccentric pivot 78 and furthermore are supported in pivotable manner at a third pivot 76 and in displaceable manner along the shaft of the fore leg 11. When the motor 24 drives the fore leg 11 through the first drive unit 18, this fore leg will be alternatingly raised and lowered on account of the eccentric pivot 78. The corresponding opposite fore leg 10 (FIG. 2) is correspondingly but oppositely raised and lowered. Additionally there is a forward and backward movement of the fore legs 10 and 11 on account of the simultaneous support and guidance at the third pivot 76. In this manner the mechanical dog is endowed with a walk-like mechanical advancing movement.

The drive mechanism 18 also drives the actuator 54. In this process the motor 24 drives by means of the first drive mechanism 18 either the actuator 54 or the fore legs 11, 10. In the shown embodiment, the actuator 54 is a disk with salients 64 that upon rotation of the disk 54 sequentially cooperate with an end 66 of the head lever 56. This head lever 56 swings about a pivot and at the same time actuates a mechanical tongue 58 and a bellows 60. First the bellows 60 is compressed and then it is released impulsively when a salient 64 disengages from the end 66 of the head lever 56 on account of the rotation of the disk 54. Simultaneously air is pulled through a noise maker 108 and a tube 110 so that the mechanical dog gives off a corresponding noise or a sound predetermined by the noise maker 108 at the same time it moves its tongue. Preferably the noise maker 108 simulates barking.

Furthermore the first drive mechanism 18 includes a gearing unit 20 with shafts 106, this gearing unit 20 being elucidated below in relation to FIGS. 4 and 5.

The fore legs 10 and 11 are connected by a lever 80 to the corresponding hind legs 12 and 13 behind them. One side of the lever 80 acts on the eccentric pivot 78 of one fore leg 11 and the corresponding other end 82 of the lever 80 cooperates through a linkage point 112 with a lever 84 linking the corresponding hind leg 13 by means of this pivot 14. When the eccentric drive 78 moves the fore legs 11, 10 therefore, the lever 80 pivots the corresponding hind legs 12, 13 at the same time as the fore legs 10, 11, but in the opposite directions, about the pivot 14.

Moreover, as shown by FIGS. 1 and 2, the mechanical dog comprises at its rear a second drive mechanism 30. This second drive mechanism 30 selectively actuates either the liquid pump 94 or, by means of a disk 38 fitted with a gearing unit not visible in FIGS. 1 and 2, the hind leg 13. In addition to the pivot 14, the hind leg 13 is supported on a pivot 26 to be pivotable about an axis of rotation 28. As shown in particular in FIG. 2, the axes of rotation 16 and 28 of the pivots 14 and 26 of the hind leg 13 are substantially perpendicular to each other. As a result, when the mechanical dog carries out its normal walk, the hind leg 13 swings to-and-fro about the pivot 14 by means of the linkage of the lever 80. Additionally, however, the hind leg 13 may be swung about the axis of rotation 28 laterally away from the mechanical dog by the second drive mechanism 30 acting through the disk 38. Preferably this pivoting motion shall take place when the remaining legs 10, 11, and 12 are still, that is when the mechanical dog is not driven forward. This "leg raising" simulates the behavior of a real dog illustratively relieving itself at a tree trunk. This typical dog behavior to scent their territory therefore can be simulated or copied in this operation of the mechanical dog. If the hind leg 13 is correspondingly raised about the axis of rotation 28, the second drive mechanism 30 will actuate the plunger 102 of the liquid pump 94 and will move liquid out of the container 88 through the liquid hose 90 to an outlet or a discharge 134 of the hose 90 at the rear 92 of the mechanical dog. The liquid issues from the discharge 134 and the mechanical dog displays the life-like behavior of a dog relieving itself.

The forward motion generated by the first drive mechanism 18 and the dog's relieving operation powered by the second drive mechanism 30 will be carried out selectively, that is either the drive mechanism 18 or the drive mechanism 30 will be actuated.

The desired operation of forward motion or of relieving can be controlled by an operator using an operating means by appropriately using a selection means. If the mechanical dog is in the "forward motion" mode and the operation "relieving" were initiated immediately when the operator switches the control means, the fore legs 10, 11 and the rear leg 12 on occasion might be in such an adverse position that the mechanical dog would fall down upon raising the hind leg 13. To prevent such a possibility, the "relieving" mode is initiated only for a given configuration of the legs 10, 11 and 12. The optimal leg position is such that the fore leg 10 diagonally opposite the raising hind leg 13 subtends a horizontally smaller distance between the drive shaft 22 and the ground than the remaining legs 11 and 12. In this configuration the mechanical dog rests in a stable three-legged position.

The "relieving" operation in the stable three-leg configuration of the embodiment is shown in FIG. 2 is implemented by a switch 74 actuated by a control means 86 at the lever 80 between the fore leg 10 and the hind leg 12. As shown by FIG. 2, the switch 74 will be actuated by the control means 86 only when the lever 80 and hence the fore leg 10 are in their farthest forward position, while simultaneously the legs 11 and 12 are pivoted into a rear position. These legs 11 and 12 thereby are farther away from the ground relative to the drive shaft 22 and the fore leg 10 and accordingly the mechanical dog shall rest on them.

When commanding the "relieving" mode during the forward-motion mode, the dog moves on a little yet until the corresponding position of the legs 10, 11 and 12 has been adjusted and the control means 86 actuates the switch 74. This switch 74 then starts the second drive mechanism 30 while stopping the first drive mechanism 18. In this process the operating system and the selection means at this operating system are connected in such manner with the drive mechanisms 18 and 30 and the switch 74 that switching reversal can take place only when commanded by the operator at the operation system by means of the selection means. So long as the case is otherwise, while the control means 86 does in fact constantly act on the switch 74 during forward motion, an appropriate electrical circuit nevertheless will prevent starting the second drive mechanism.

If inversely an operator commands again the forward-motion mode during the dog's relieving mode with raised hind leg 13, the change from the drive mechanism 30 to the drive mechanism 18 will not be abrupt either, rather another switch, not further shown, will be actuated for a given position of the disk 38. Preferably this position of the disk 38 is selected in such manner that the hind leg 13 shall be firmly on the ground to allow implementing the forward-mode of the mechanical dog without danger of its falling down. The delay in switching from the drive mechanism 30 to the drive mechanism 18 again is implemented by electrically wiring the operating system to the drive mechanisms 18, 30 and the corresponding switches.

As is further shown in FIGS. 1 and 2, the affixation of the hind legs 12 and 13 differ basically in relation to the additional function of the hind leg 13. Whereas, as shown in FIG. 2, the hind leg 12 is screwed in place by a screw 114, the hind leg 13 is associated with two axes of rotation 16 and 28. To endow the hind leg 13 with a rotatable degree of freedom both about the axis 16 as well as about the axis 28, the second lever 84 must be designed accordingly. This lever 84 encloses the pivot 14 like a horseshoe (FIG. 1) and forms the additional axis of rotation 28 at the end of the horseshoe.

The two drive mechanisms 18 and 30 are rigidly mounted in the housing 32, that is they are mutually immobile. The second drive mechanism 30 illustratively is affixed by a screw 104 to a shell segment of the torso 32.

Figure 3:
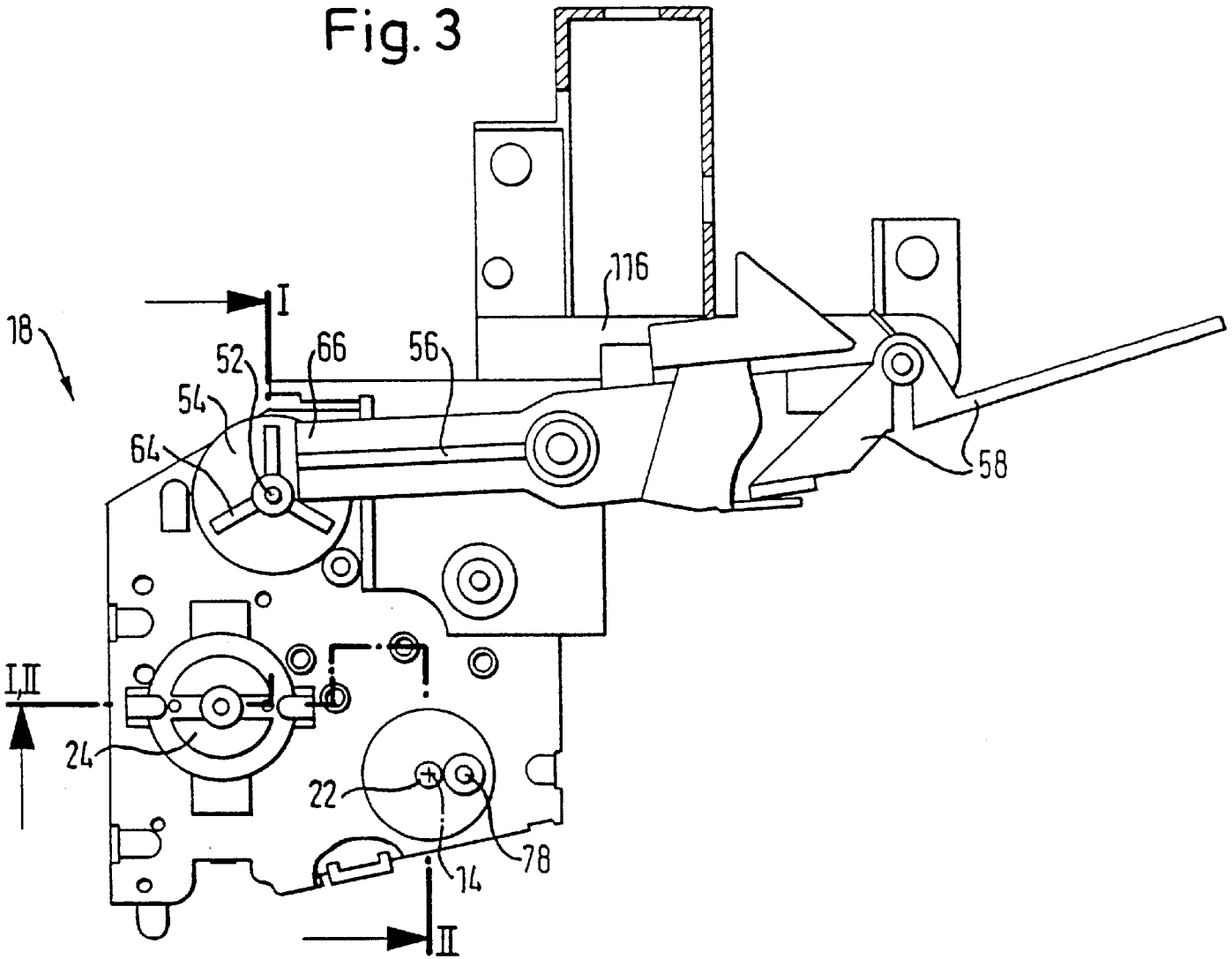
FIG. 3 is a sideview of a first drive mechanism.

The first drive mechanism 18 is elucidated below in relation to FIG. 3. By means of a gearing unit not visible in FIG. 3, the motor 24 drives selectively either the first drive shaft 22 with pivot 14 or the second drive shaft 52. The eccentric pivot 78 is a distance from the first drive shaft 22 and, as shown in FIG. 1, cooperates correspondingly with a fore leg 10, 11. A disk-shaped actuator 54 with salients 64 is mounted to the second drive shaft 52. As the disk 54 rotates, the salients 64 consecutively engage and end 66 of the lever 56 which they drive correspondingly. The head lever 56 drives the tongue 58 and a bellows not elucidated in FIG. 3. A head support 116 links the head part 62 not shown in FIG. 3 to the first drive mechanism 18.

Figure 4:
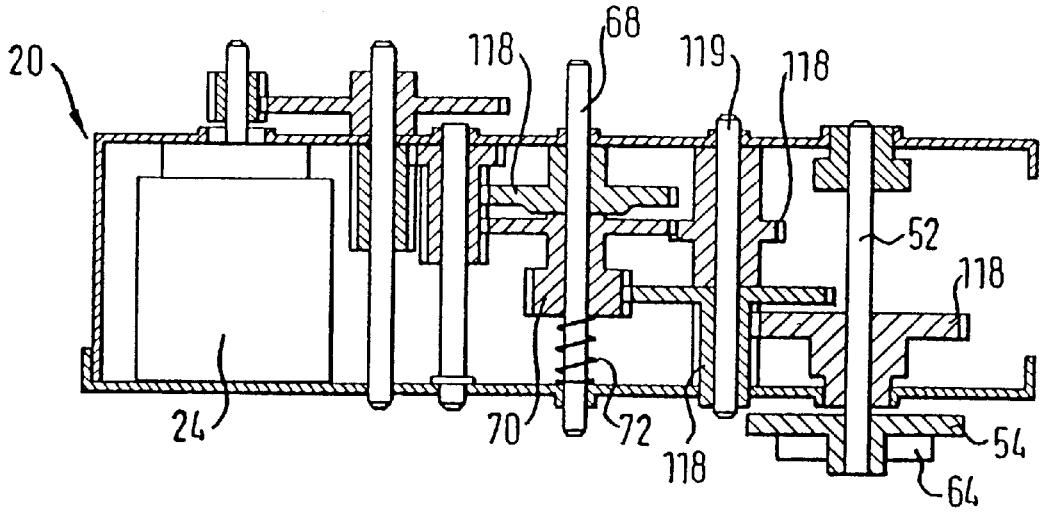
FIG. 4 is a section along line I—I of FIG. 3.
Figure 5:
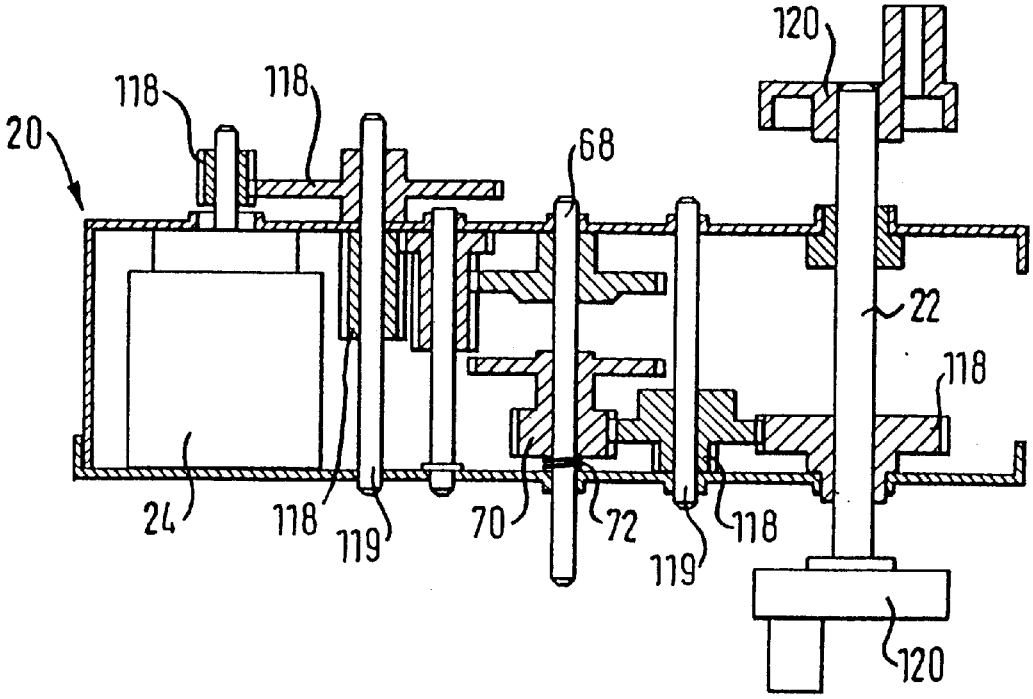
FIG. 5 is a section along line II—II of FIG. 3.

The first gearing unit 20 shown in FIGS. 4 and 5 comprises several gears 118 and corresponding shafts 119 and also the first drive shaft 22 (FIG. 5) and the second drive shaft 52 (FIG. 4). An axially displaceable gear 70 loaded by a spring 72 is mounted on a shaft 68. FIGS. 4 and 5 show the upper or the lower position of the displaceable gear 70. As shown by FIG. 4, in its upper position the gear 70 transmits a drive force to the second drive shaft 52, thereby driving the actuator 54 and the lever 56 at its end 66, thereby powering the tongue 58 and the bellows 60 (FIG. 1). If, on the other hand and as shown in FIG. 5, the axially displaceable gear 70 is displaced downward, it will transmit a drive force to the first drive shaft 22 and by means of pins at the eccentric pivots will drive correspondingly the fore legs 10 and 11 (FIGS. 1, 2) to implement a forward walk. Therefore the displacement of the gear 70 will alternatingly implement the dog's forward motion or its barking. Additional control of the electric motor 24 or even a change in angular speed or the like are not needed.

Figure 6:
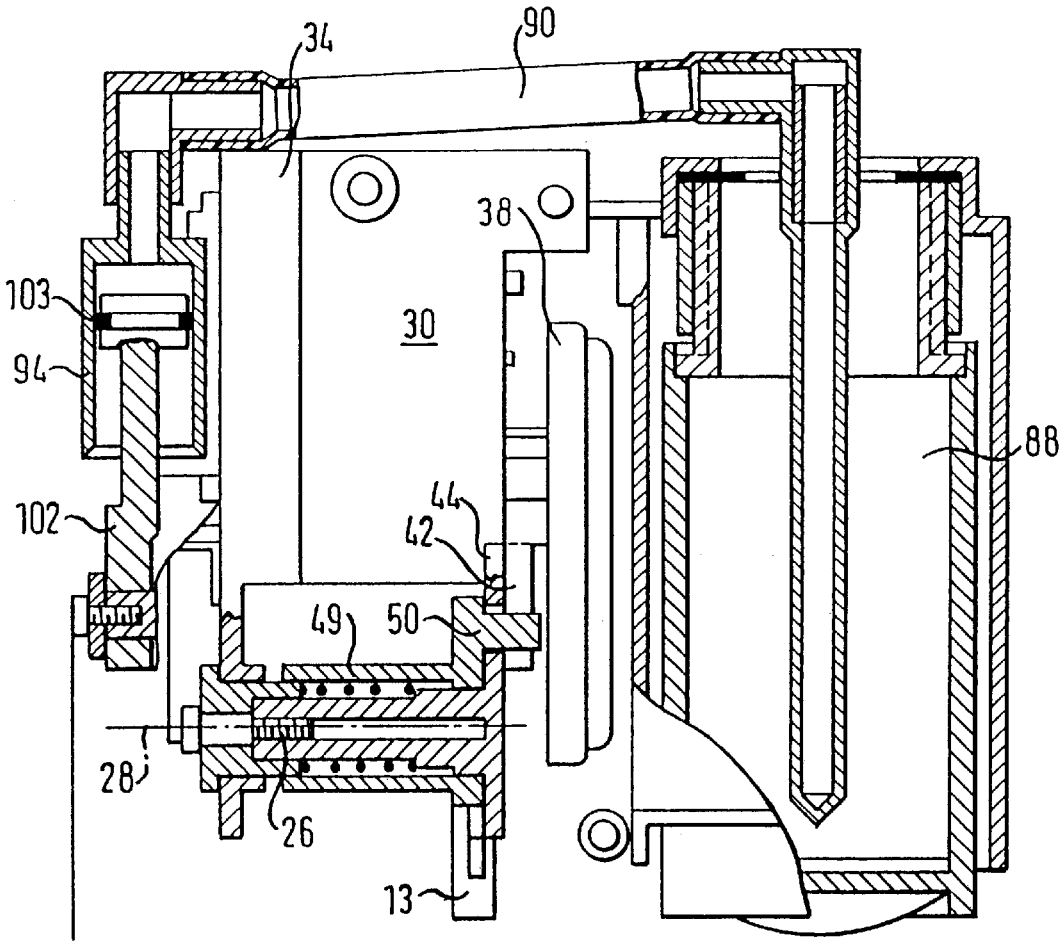
FIG. 6 is a sectional sideview of a second drive mechanism fitted with a water spray.

FIG. 6 shows the second drive mechanism 30 with the surrounding water system consisting of a liquid container 88, liquid hose 90 and water pump 94 with plunger 102. The second drive unit 30 further comprises a gearing unit 34 not elucidated in FIG. 6. This gearing unit 34 is discussed further below in relation to FIG. 5.

The second drive mechanism 30 also comprises a disk 38 which by means of a gearing unit not visible in FIG. 6, further by means of a cam pin 42 of a compensating lever 44 and a second cam pin 49 at a lever 50 implements the lateral pivoting of the hind leg 13 about the axis of rotation 28. FIG. 6 merely outlines the hind leg 13 and detailed discussion is excluded.

The action of laterally pivoting the hind leg 13 by the disk 38 is shown in FIGS. 7*a* through 7*l* by twelve different positions of the disk 38. In this respect the disk 38 is fitted with a cam slot 40 engaged by a first cam pin 42 of a compensating lever 44. The compensating lever 44 is rotatably supported at a pivot 46. Moreover the lever 44 is fitted with a second cam slot 48 engaged by a cam pin 49 of another lever 50. In turn this lever 50 acts on the additional pivot 26 of the hind leg 13 to control this hind leg 13, that is, rotation of the lever 50 entails pivoting the hind leg 13 at the pivot 26 about the axis of rotation 28. In FIGS. 7*a* through 7*l*, the axis of rotation 28 at the pivot 26 is perpendicular to the plane of the drawing. The hind leg 13 is not shown pictorially for sake of clarity in showing the dog's motion.

Figures 7A, 7B, 7C, 7D, 7E, 7F:
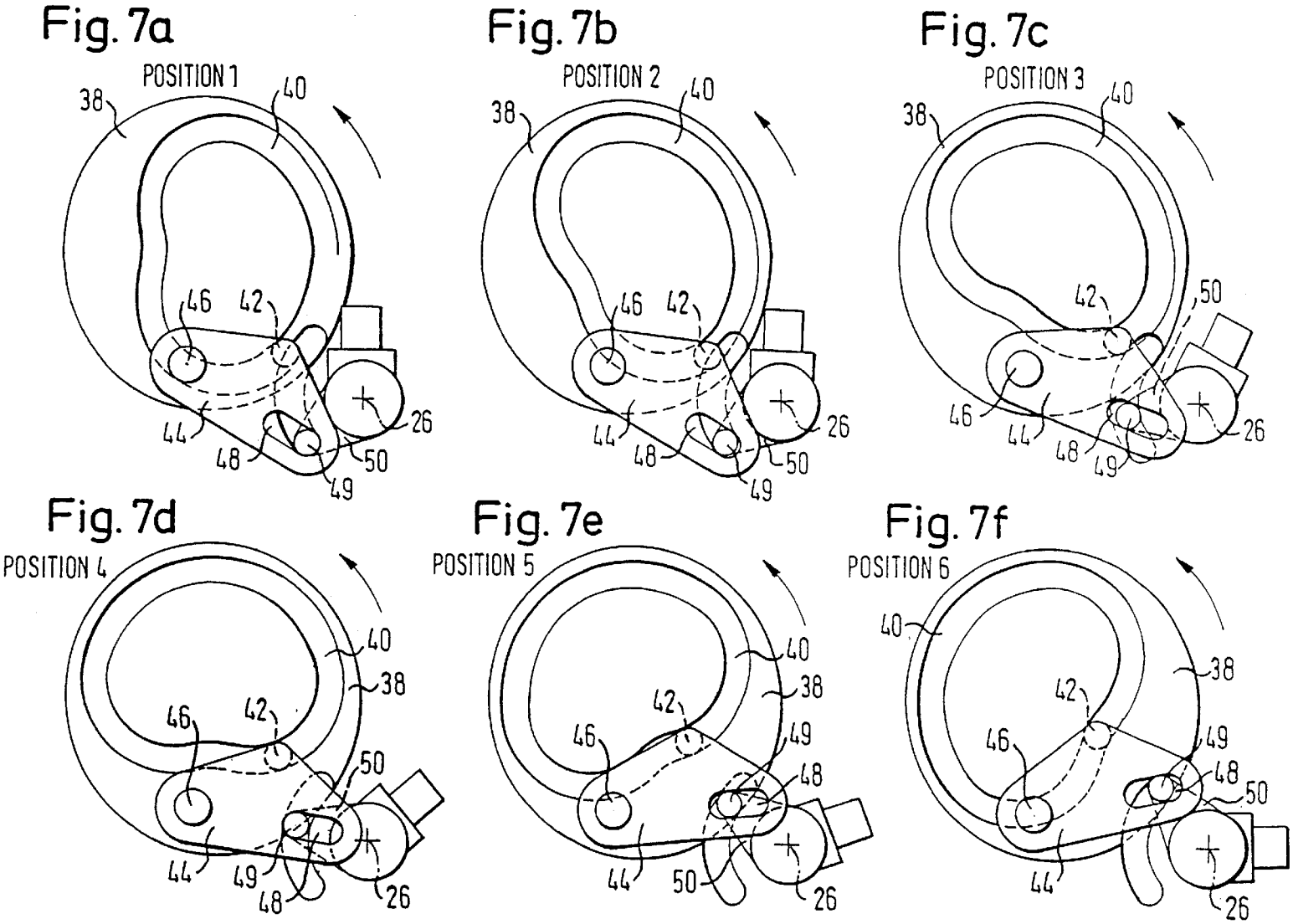
FIGS. 7*a*–7*l* show schematically a cam pin guidance system for the dog's hind leg.
Figure 7G:
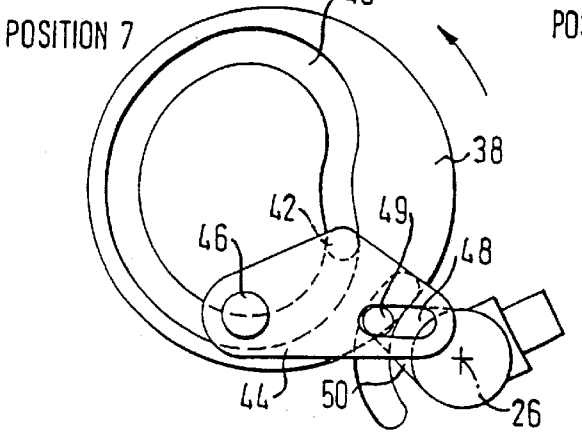
Figure 7H:
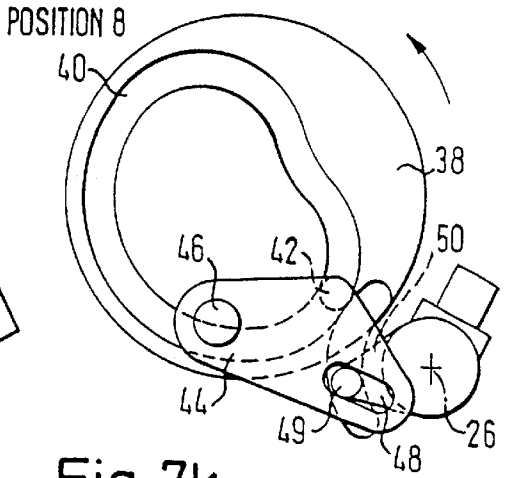
Figure 7I:
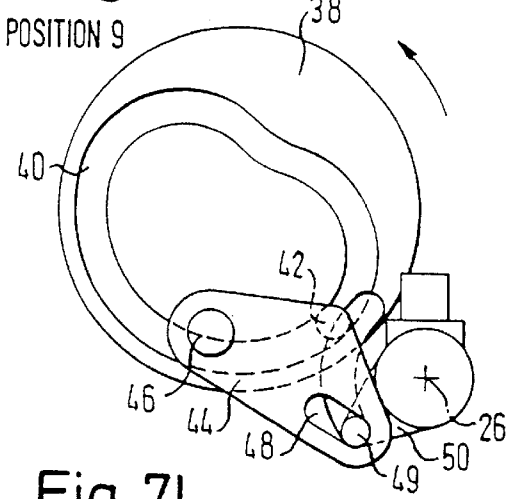
Figure 7J:
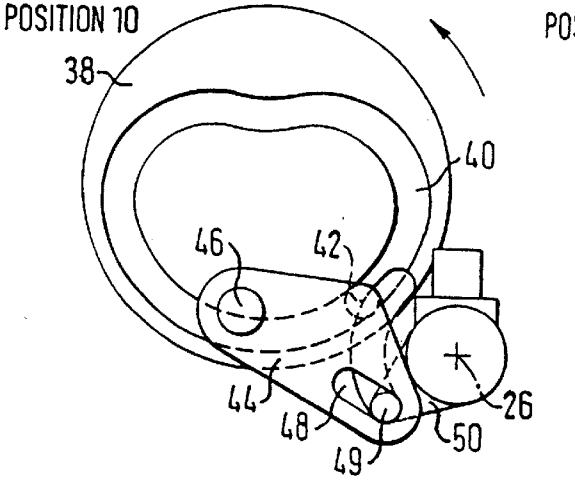
Figure 7K:
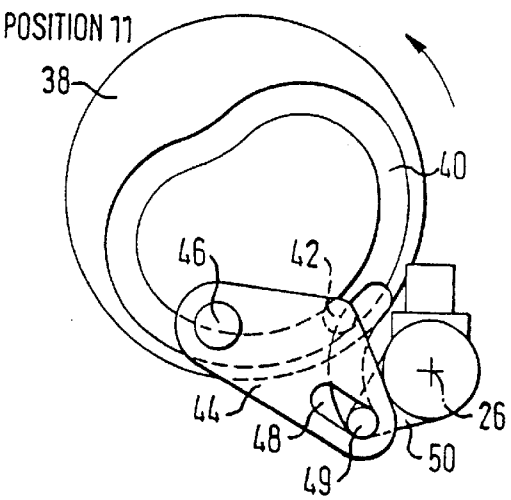
Figure 7L:
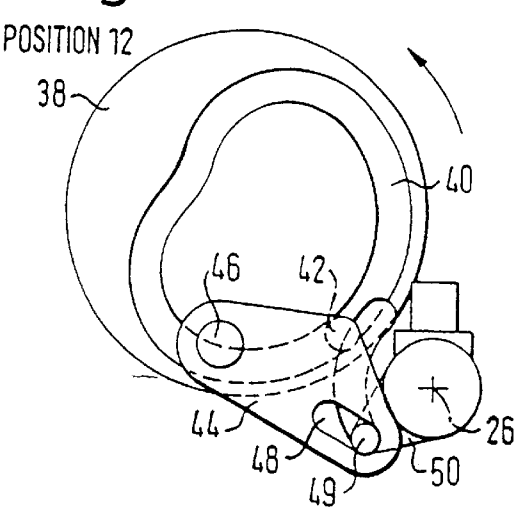

When the disk 38 is rotated, the gearing unit 50 through the first cam pin 42 forces the compensating lever 44 to move up from the initial position 1 in FIG. 7*a* to the position 6 in FIG. 7*f*. This motion constrains a corresponding rotation by means of the cam pin 49 to the lever 50 to implement pivoting the hind leg 13 sideways. In position 6 of FIG. 7*f*, the hind leg 13 at last has been fully pivoted and the cam slot 40 has been designed in such manner that at constant, continued rotation of the disk 38, the pivoted hind leg 13 shall remain a predetermined time in its swung-out position. As the disk 38 continues to rotate, the course of the cam pin 42 in the cam slot 40 implements swinging back the hind leg 13. This sequence is shown in detail by positions 7 through 12 in FIGS. 7*g* through 7*l*. The compensating lever 44 pivots downward about its pivot 46 and correspondingly rotates the lever 50. In position 12 of FIG. 7*l*, the hind leg 13 has been fully retracted. In this position, if commanded by an operator, forward motion would be resumed by the disk 38 by actuating an omitted switch OFF the second drive mechanism 30 and to switch ON again the first drive mechanism 18, reinstating the operation of forward motion alternating with barking.

Figure 8:
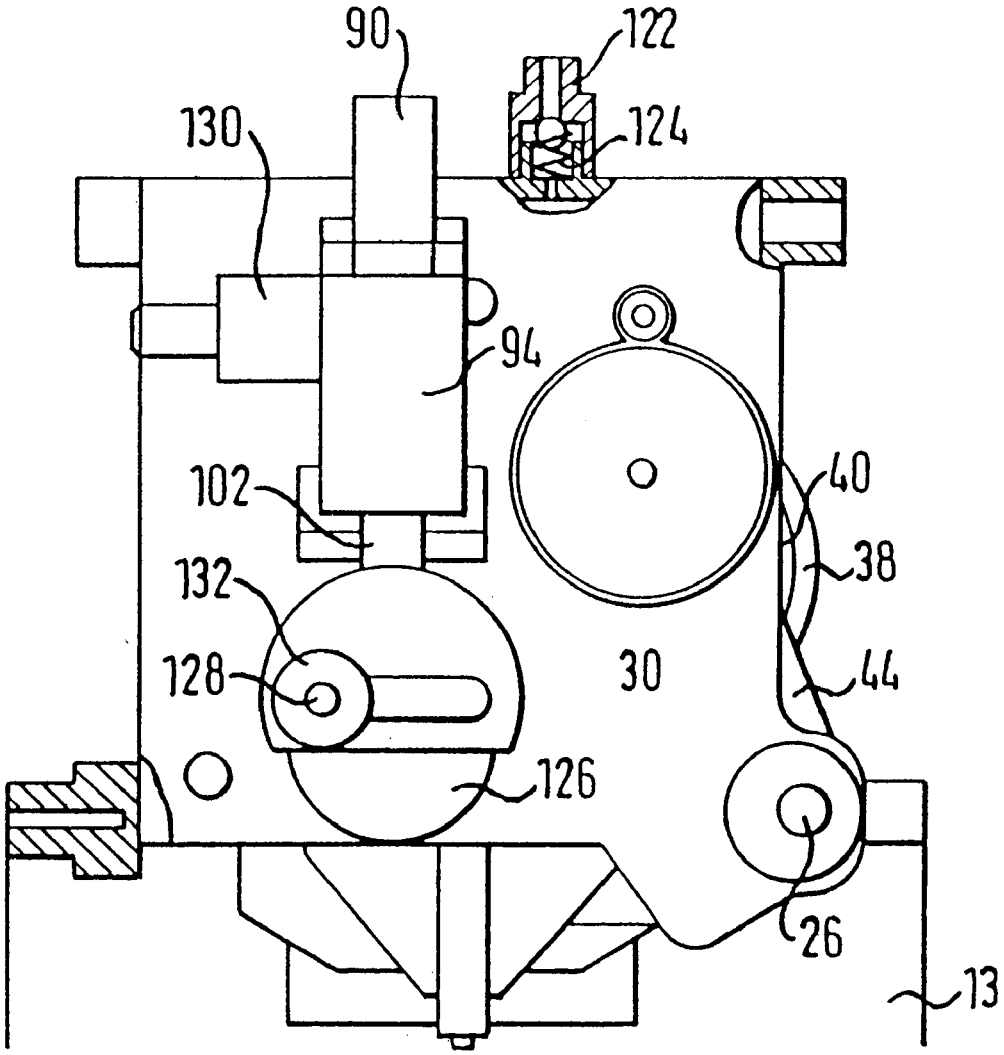
FIG. 8 is a rear view of the second drive mechanism of FIG. 6.

The second drive mechanism 30 actuates selectively not only the disk 38 swinging out the hind leg 13, but also the water pump 94. FIG. 8 is a rear view of the second drive mechanism 30 showing part of the water supply. The plunger 102 of the liquid pump 94 is driven by a rotary disk 126 and an eccentric pivot 128. The rotation of the disk 126 is converted into a reciprocating motion of the plunger 102. The lower end of the plunger 102 is eccentrically connected through a shim disk 132 with the rotating disk 126.

The water supply further comprises an air valve 122 fitted with a spring 124. A water valve 130 is also mounted in the water system.

Figure 9:
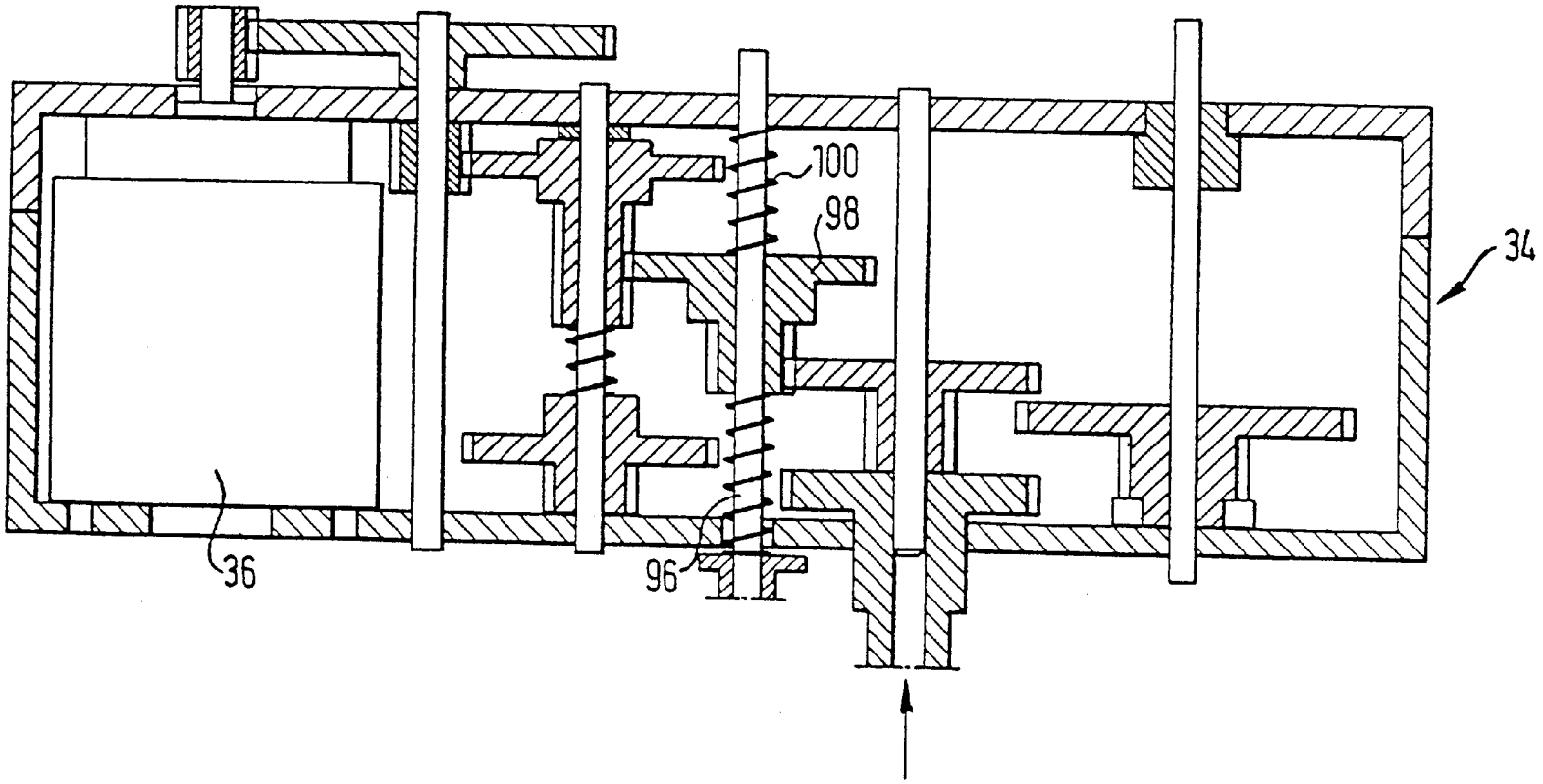
FIG. 9 is a sectional topview.

FIG. 9 elucidates the selective control of the water pump 94 or of the disk 38. It shows the second gearing unit 34. By means of various gears and shafts, a motor 36 drives a gear 98 on a shaft 96. The gear 98 is axially displaceable along the shaft 96 and is spring-loaded by a spring 100. When the gear 98 is axially displaced, it meshes with various gears and in this manner the force exerted by the electric motor 36 is transmitted either to a drive shaft of the rotating disk 126 or to a drive shaft of the disk 38.

What is claimed is:

1. A mechanical model of an animal that lifts a leg during urination comprising a torso, fore legs and hind legs coupled to the torso and arranged to drive the animal model in a direction of motion, each of the hind legs being rotatably supported about a first pivot having an axis of rotation perpendicular to the direction of motion of the animal model, each of the fore legs being coupled by a first drive mechanism with a first gearing unit having a first drive shaft, at least one of said hind legs being rotatably supported at a second pivot having an axis of rotation, the axes of rotation of the first and second pivots of the at least one of said hind legs being offset by a predetermined angle from each other, a second drive mechanism for selectively moving at least one of said hind legs about the second pivot, the first and second drive mechanisms being mutually rigidly configured in the torso.

2. Animal model as claimed in claim 1, wherein the angle between the two axes of rotation is 90°.

3. Animal model as claimed in claim 1, wherein the first drive mechanism includes an electric motor.

4. Animal model as claimed in claim 1, wherein the second drive mechanism for the at least one of said hind legs including the second pivot comprises a second gearing unit independent of the first gearing unit for driving the at least one of said hind legs about the second pivot.

5. Animal model as claimed in claim 1, wherein the second drive mechanism includes an electric motor.

6. Animal model as claimed in claim 1, wherein the second drive mechanism comprises a disk having a first cam slot, a first cam pin in the first cam slot for engaging the first cam slot, a compensating lever carrying the first cam pin, the compensating lever resting on a pivot and including a second cam slot, a second cam pin in the second cam slot for engaging the second cam slot, another lever carrying the second cam pin for coupling the at least one of said hind legs to the second pivot in such manner that upon rotation of the disk, the another lever rotates the at least one hind leg about the second pivot to-and-fro by an angle predetermined by the first cam slot.

7. Animal model as claimed in claim 1, wherein the model includes a head having at least one of (a) a rotatable jaw, (b) a movable tongue and (c) a bellows, the first gearing unit including a second drive shaft, and further including an actuator affixed to the second drive shaft for actuating a head lever for driving at least one of the rotatable lower jaw, movable tongue and the bellows.

8. Animal model as claimed in claim 7, wherein the actuator includes a rotary disk with at least one salient for engaging one end of the head lever.

9. Animal model as claimed in claim 1, wherein the first gearing unit of the first drive mechanism comprises at least one shaft axially displaceable into a first and into a second position, the at least one shaft being fitted with at least one gear, the at least one gear being arranged for transmitting in the first position of the at least one shaft a drive force to the first drive shaft and in the second position of the at least one shaft a drive force to the second drive shaft.

10. Animal model as claimed in claim 9, further including a spring for biasing the gear so the gear is axially displaceable against force of the spring.

11. Animal model as claimed in claim 9, further including a spring for biasing the further shaft so the further shaft is axially displaceable against force of the spring.

12. Animal model as claimed in claim 1, wherein the first gearing unit of the first drive mechanism comprises a further shaft fitted with a gear axially displaceable into a first and into a second position, the gear being arranged for transmitting in its first position a drive force to the first drive shaft and in its second position a drive force to the second drive shaft.

13. Animal model as claimed in claim 1, further including an operator responsive switch arrangement for automatically activating the second drive mechanism and deactivating the first drive mechanism and for automatically activating the first drive mechanism and deactivating the second drive mechanism.

14. Animal model as claim in claim 13, wherein the switch arrangement includes a first switch for automatically activating only the second drive mechanism and deactivating the first drive mechanism.

15. Animal model as claimed in claim 14, wherein the first switch is in such a position that it can be automatically actuated in one position of one of the fore legs, the one position being such that one of the fore legs diagonally opposite the at least one of said hind legs and rotatably supported at the second pivot is vertically closer to a surface on which the model is adapted to stand relative to the first drive shaft than the other fore leg and the other hind leg.

16. Animal model as claim in claim 14, wherein the switch arrangement includes a second switch for automatically activating only the second drive mechanism and deactivating the second drive mechanism.

17. Animal model as claimed in claim 1, further including an operating system fitted with an operator responsive selector for transmitting a command to the mechanical animal model for selectively activating at least one of the first and a second drive mechanisms.

18. Animal model as claimed in claim 17, wherein the selector is arranged for transmitting an operator command to a first and a second switch on the model.

19. Animal model as claimed in claim 17, wherein the operating system includes wires for transmitting signals from the selector to the switches.

20. Animal model as claimed in claim 17, wherein the selector includes a three-position switch having: (a) a first switching position for deactivating the mechanical animal model, (b) a second position for transmitting a command to actuate the first drive mechanism and (c) a third position for transmitting a command to actuate the second drive mechanism.

21. Animal model as claimed in claim 17, wherein the operating system comprises a power supply for powering the first and second drive mechanisms.

22. Animal model as claimed in claim 21, wherein the power supply includes a battery.

23. Animal model as claimed in claim 21, wherein the operating system includes wires for selectively coupling power from the power supply to the drive mechanisms via the switches.

24. Animal model as claimed in claim 1, wherein the first drive mechanism includes an eccentric link between the fore legs, the first gearing unit and the first drive shaft, and further including a third pivot rotatably supporting the fore legs at a position removed from the first pivot, the forelegs being displaceably supported in the direction of a longitudinal axis of the fore legs.

25. Animal model as claimed in claim 24, wherein each of the fore legs includes a first eccentric pivot, a first lever having a first end mounted for acting on each first eccentric pivot of each of the fore legs, the other end of the first lever being rotatably connected to a second lever mounted for acting on the first pivot of one of the hind legs.

26. Animal model as claimed in claim 25, further including a first switch, an actuator for driving a first switch, the actuator being mounted on the first lever in such manner that the switch can be actuated by the actuator when one of the fore legs is diagonally opposite one of the hind legs to be actuated and the second pivot is vertically closer to a surface on which the model is adapted to stand relative to the first drive shaft than the other fore leg and the other hind leg.

27. Animal model as claimed in claim 1, further including a liquid container and a liquid hose running from the container to a rearward portion of the animal model, a pump selectively driven by the second drive mechanism for moving liquid from the container to the rearward portion and for discharging the liquid through an aperture at one end of the hose.

28. Animal model as claimed in claim 27, wherein the second drive mechanism comprises a disk having a first cam slot, a second gearing unit having a shaft axially displaceable into a first and a second position and at least one gear, the gear being arranged for transmitting (a) a drive force to the disk when the shaft is in the first position and (b) a drive force to a plunger of the liquid pump when the shaft is in the second position.

29. Animal model as claimed in claim 28, further including a spring for biasing the shaft and for causing displacement of the shaft.

30. Animal model as claimed in claim 27, wherein the second drive mechanism comprises a disk having a shaft having at least one gear axially displaceable into a first and into a second position, the gear being arranged for transmitting (a) a drive force to the disk when the gear is in the first position and (b) a drive force to a plunger of the liquid pump when the gear is in the second position.

31. Animal model as claimed in claim 30, further including a spring for biasing the gear for causing displacement of the gear.

32. Animal model as claimed in claim 1, further including switches coupled between an operating system and the drive mechanisms, a selector, the switches being electrically connected by the selector to a power source in such manner as to create two bistable states for alternate activation and deactivation of the drive mechanisms in such a way that, following selection at the selector by switch actuation, one drive mechanism is activated and the corresponding other drive mechanism is deactivated and the activated state remains preserved in a stable manner until the switch is actuated after a new selection at the selector.

* * * * *